United States Patent [19]

Herron

[11] Patent Number: 4,804,002

[45] Date of Patent: Feb. 14, 1989

[54] TOBACCO PRODUCT CONTAINING SIDE STREAM SMOKE FLAVORANT

[75] Inventor: Herron, Brevard, N.C.

[73] Assignee: P. H. Glatfelter Company, Spring Grove, Pa.

[21] Appl. No.: 55,599

[22] Filed: May 29, 1987

[51] Int. Cl.[4] ..... A24B 3/12; A24D 1/02

[52] U.S. Cl. ..... 131/365; 131/276

[58] Field of Search ..... 131/365, 276

[56] References Cited

U.S. PATENT DOCUMENTS 3,419,543 10/1968 Mold et al. .
3,499,452 3/1970 Kallianos et al. .
4,092,988 6/1978 Van Auken et al. .
4,236,532 12/1980 Schweizer et al. ..... 131/365
4,612,942 9/1986 Dobberstein et al. .
4,643,205 2/1987 Redding et al. .

*Primary Examiner*—V. Millin

*Attorney, Agent, or Firm*—Kerkam, Stowell, Kondracki & Clarke

[57] ABSTRACT

A tobacco product wrapper containing a glycoside comprising an acetyl of a carbohydrate and an aromatic agent or a derivative thereof. The glycoside flavors or masks the side stream smoke while substantially not altering the taste or flavor characteristics of the tobacco or mainstream smoke.

34 Claims, 3 Drawing Sheets

PYROLYSIS OF ETHYL VANILLYL-D-GLUCOSIDE 4-(β-D-GLUCOPYRANOSYLOXY)-3-ETHOXYBENZALDEHYDE [ETHYL VANILLYL-D-GLUCOSIDE]

4-HYDROXY-3-ETHOXY-BENZALDEHYDE [ETHYL VANILLIN]

1,6-ANHYDRO-β-D-GLUCOPYRANOSE [LEVOGLUCOSAN]

PYROLYSIS OF ETHYL VANILLYL-D-GLUCOSIDE

SYNTHETIC SCHEME FOR ETHYL VANILLYL-D-GLUCOSIDE

TOBACCO PRODUCT CONTAINING SIDE STREAM SMOKE FLAVORANT

BACKGROUND OF THE INVENTION

1. Field of the Invention

The present invention relates to a tobacco product containing a flavorant which flavors or masks predominantly the sidestream smoke.

2. Prior Art

It has long been conventional to alter and/or improve the flavor and aroma of tobacco products by including therein flavoring or aroma-altering substances. See, for example, U.S. Pat. Nos. 2,766,145; 3,095,882; 3,332,428 and 3,938,531. British patent Nos. 1,508,616 and 1,508,617 disclose the incorporation of, e.g., glucosides of certain compounds, which glucosides are derivable from tobacco, in tobacco products to impart a distinct tobacco flavor to smoke produced by the smoking of the tobacco product. The glucosides are preferably incorporated in tobacco substitutes to produce a tobacco flavor not otherwise present therein.

It is the purpose of the methods described in the prior art, however, to change or enhance the flavor of either the tobacco product itself or the mainstream smoke, i.e., the smoke stream inhaled by the smoker.

The sidestream smoke, i.e., the smoke produced by a burning cigarette when smoldering or not being inhaled by the smoker, is objectionable to others in the vicinity of the smoldering cigarette.

Accordingly, it is an object of the present invention to provide a tobacco product containing a flavorant or masking agent which does not substantially alter the taste or flavor characteristics of the tobacco when in use by the smoker, i.e., upon drawing and/or inhalation, but which flavors or otherwise masks the objectionable odor of the sidestream smoke.

SUMMARY OF THE INVENTION

These and other objects are realized by the present invention which provides a tobacco product wrapper containing a flavorant which (1) has substantially no aroma below its pyrolysis point, (2) pyrolyzes during smoldering of the tobacco product, which smoldering produces a sidestream smoke, the pyrolysis of the flavorant releasing an aromatic agent which primarily masks the offensive odor of the sidestream smoke, and (3) does not significantly transfer to the mainstream smoke produced during smoking of the tobacco product, thereby producing a mainstream of smoke which is not substantially flavored or substantially masked by the aromatic agent.

A further embodiment of the invention is an article comprising a tobacco product enclosed in a wrapper and adapted for smoking wherein the wrapper contains the above-described flavorant.

DETAILED DESCRIPTION OF THE INVENTION

The present invention is predicated on the discovery that certain materials have substantially no effect on the flavor and/or aroma of the mainstream smoke produced by an article containing the tobacco product but which pyrolyzes during the smoldering thereof to produce a flavorant which masks the offensive odor of the sidestream smoke produced thereby.

The following definitions apply with respect to the terms employed herein to describe the invention.

The term, "tobacco product", includes any material employed in an article designed for burning to produce a smoke intended for inhalation by a smoker thereof, e.g., tobacco, a tobacco substitute, an additive to a tobacco or tobacco substitute.

The term "wrapper" includes any material utilized to wrap or enclose a tobacco product, e.g., cigarette paper, cigar wrapper, etc.

The term, "mainstream smoke", describes the smoke stream produced by the burning occasioned by puffing on a lighted article containing a tobacco product and intended for tasting, inhalation and/or other form of enjoyment by the smoker.

The term, "sidestream smoke", describes the smoke produced by the smoldering of a lighted article containing a tobacco product when not being puffed and not intended for enjoyment by the smoker.

Any flavorant material which does not materially affect the flavor or aroma of a tobacco product or the mainstream smoke produced by the burning thereof but which pyrolyzes on combustion and smoldering to produce an aromatic agent which masks the offensive odor of sidestream smoke may be employed in the practice of the invention.

The flavorant may be incorporated in the wrapper, e.g., cigarette paper, in order to minimize any effect thereof on the mainstream smoke while ensuring a maximum odor masking effect on the sidestream smoke.

A preferred class of flavorants are the glycosides, i.e., acetals of a carbohydrate and the aromatic agent or derivative thereof.

Particularly preferred are those glycosides wherein the carbohydrate is a saccharide.

Most preferred for use in the present invention are the glucosides.

The aromatic agent may comprise any material capable of forming the flavorant material and which serves, upon release by pyrolysis, to mask the offensive odor of the sidestream smoke. Suitable aromatic agents or derivatives thereof include phenolic compounds such as vanillin, ethyl vanillin, methyl salicylate, eugenol, isoeugenol, coumarin, thymol, propenyl guaethol, etc., cyclic and acyclic enolic compounds such as maltol, ethyl maltol, methyl cyclopentenolone, alpha-ketofuranones, etc., and cyclic and acyclic aliphatic alcohols such as menthol.

Figure 2:
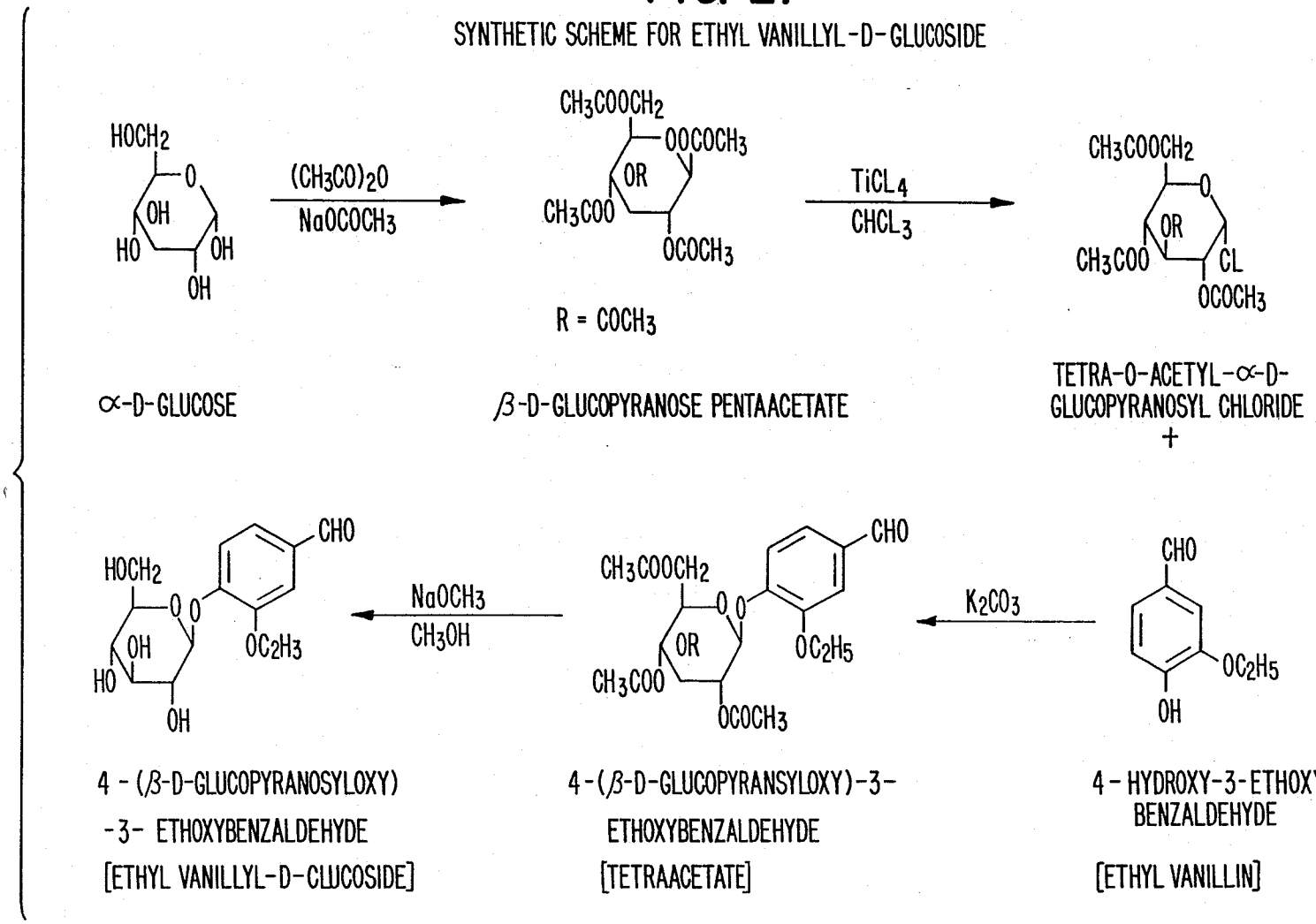
FIG. 2 depicts a reaction scheme for the synthesis of a product according to the present invention.

The glycoside flavorants may be prepared according to known methods for preparing acetals. A typical preparation is illustrated in FIG. 2, which depicts a reaction scheme for preparing ethyl vanillyl-O-glucose, a preferred flavorant according to the invention.

Figure 1:
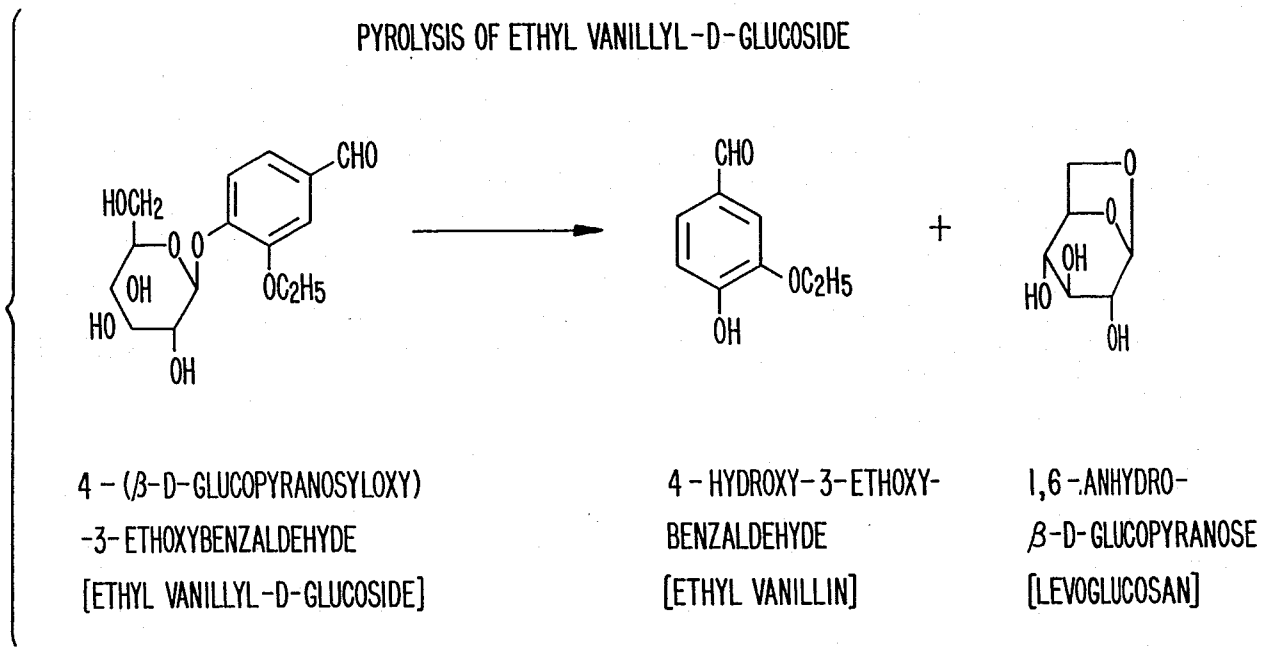
FIG. 1 depicts a reaction scheme illustrating the pyrolysis of a product according to the present invention.

FIG. 1 depicts the reaction scheme of the pyrolysis of ethyl vanillyl-O-glucose at the temperatures produced by the combustion and smoldering of a tobacco product to produce the aromatic agent, ethyl vanillin.

Incorporation or impregnation in the wrapper of the glycoside derivative of the aromatic masking agent is preferred over direct incorporation of the agent in the tobacco product since the aromatic or flavoring characteristics thereof are masked until released by pyrolysis at smoldering temperatures. At idle, (i.e., when the tobacco product has been "lighted" but is not being actively smoked to produce a mainstream smoke) temperature ramp rates within the cigarette, especially at the periphery, are significantly lower than during a puff when air is actively drawn through the cigarette. The lower temperature ramp rate at the periphery allows the flavoring agent incorporated in the wrapper to pyrolyze in a fashion that the volatile flavoring agent is released to the surrounding atmosphere in the sidestream smoke. During a puff, however, the much more rapid increase in temperature causes the immobilized flavoring agent to be consumed rather than released, such that the aroma noticeable in the sidestream smoke is not noticeable in the mainstream smoke. Consequently, there is little or no flavoring of the mainstream smoke thereby maintaining the flavor balance of the tobacco products.

The invention is illustrated by the following non-limiting examples.

EXAMPLE 1

Tetra-O-acetyl-60 -D-glucopyranosyl chloride (1.59 grams, 4.34 millimoles) [R. U. Lemieux, *Methods in Carbohydrate Chemistry,* Vol. II, pp. 224–225] was combined with ethyl vanillin (3.60 grams, 21.7 millimoles) and anhydrous potassium carbonate (0.60 grams, 4.34 millimoles) and dry (over solid potassium hydroxide) tetrahydrofuran (43 mL THF). The THF was removed by atmospheric distillation under a stream of dry nitrogen (oil bath, 110 degrees C.) and the stirred residue held at 110 degrees C. for five hours. The reaction flask was cooled to room temperature and the crude product chromatographed on silica gel (100 grams) with a linear carbon tetrachloride/chloroform gradient. The desired material, an amber syrup which solidified on standing (1.20 grams, 56%), was found to elute with 50% $CHCl_3/CCl_4$ and possessed satisfactory spectral properties: IR: film, Perkin-Elmer 137 Spectrometer; aldehyde C—H (2760 $cm^{31\ 1}$), ester carbonyl (1750 $cm^{31\ 1}$, broad), conjugated aldehyde carbonyl (1720 $cm^{31\ 1}$).

NMR: $CDCl_3$/Tetramethylsilane solvent/standard, Bruker A-300 Spectrometer; 9.85 ppm (s, 1H)=aldehyde H, 7.38 ppm (m, 2H)=aromatic H ortho to —CHO, 7.17 ppm (m, 1H)=aromatic H ortho to glycosidic linkage, 5.25–5.33 ppm (m, 2H) and 5.10–5.19 ppm (m, 2H)=C-1,2,3,4 ring H, 4.15–4.28 ppm (m, 2H)=C-6 methylene group, 4.08 ppm (d, J=7.0 Hz, 2H)=—$OCH_2CH_3$ methylene group, 3.72 1H)=C-5 methine H, 2.05, 2.04, 2.03, 2.02 ppm (s, 3H)=acetate methyl groups, 1.43 ppm (t, J=7.0 Hz, 3H)=—$OCH_2CH_3$ methyl.

The acetate protecting groups were removed with 0.1N methanolic sodium methoxide according to the method of Ward (*Methods in Carbohydrate Chemistry,* Vol. II, pp. 394–396). The ethyl vanillyl glucoside (0.70 grams, 88%) was isolated after recrystallization from absolute ethanol (mp. 199–200 degrees C.). Observed properties were as follows:

IR: KBr disc, Perkin-Elmer 137 Spectrometer; hydroxyl O—H (3472 $cm^{31\ 1}$, strong), aldehyde C—H (2932 $cm^{31\ 1}$), conjugated aldehyde carbonyl (1706 $cm^{31\ 1}$), aromatic C=C (1610 $cm^{31\ 1}$).

NMR: D4-MeOH/TMS solvent/standard, Bruker A-300 Spectrometer; 9.83 ppm (s, 1H)=aldehyde H, 7.50–7.47 ppm (m, 2H)=aromatic H ortho to —CHO, ]b 7.31 ppm (d, J=8.2 Hz, 1H)=aromatic H ortho to glycosidic linkage, 5.09 ppm (d, J=7.3 Hz, 1H)=C-1, 4.17 ppm (d, J=7.0 Hz, 1H) and 4.16 ppm (d, J=7.0 Hz, 1H)=—$OCH_2CH_3$ methylene group, 3.88 ppm (dd, J=12.1,2.0 Hz, 1H) and 3.69 ppm (dd, J=12.5, 5.2 Hz, 1H)=C-6 methylene H, 3.30–3.58 ppm (m, 5H) ring H, 1.43 ppm (t, J=7.0 Hz, 3H)=$OCH_2CH_3$ methyl group. UV: 95% EtOH, Beckman DK-2A Spectrometer; lambda max=270 nm, epsilon=13,860; lambda=304, epsilon=8,650.

C,H,O Analysis: Galbraith Microanalyses: $C_{15}H_{20}O_8$ requires C=54.88%, H=6.14%; Found C=54.51%, H=6.06%.

EXAMPLE 2

Figure 3:
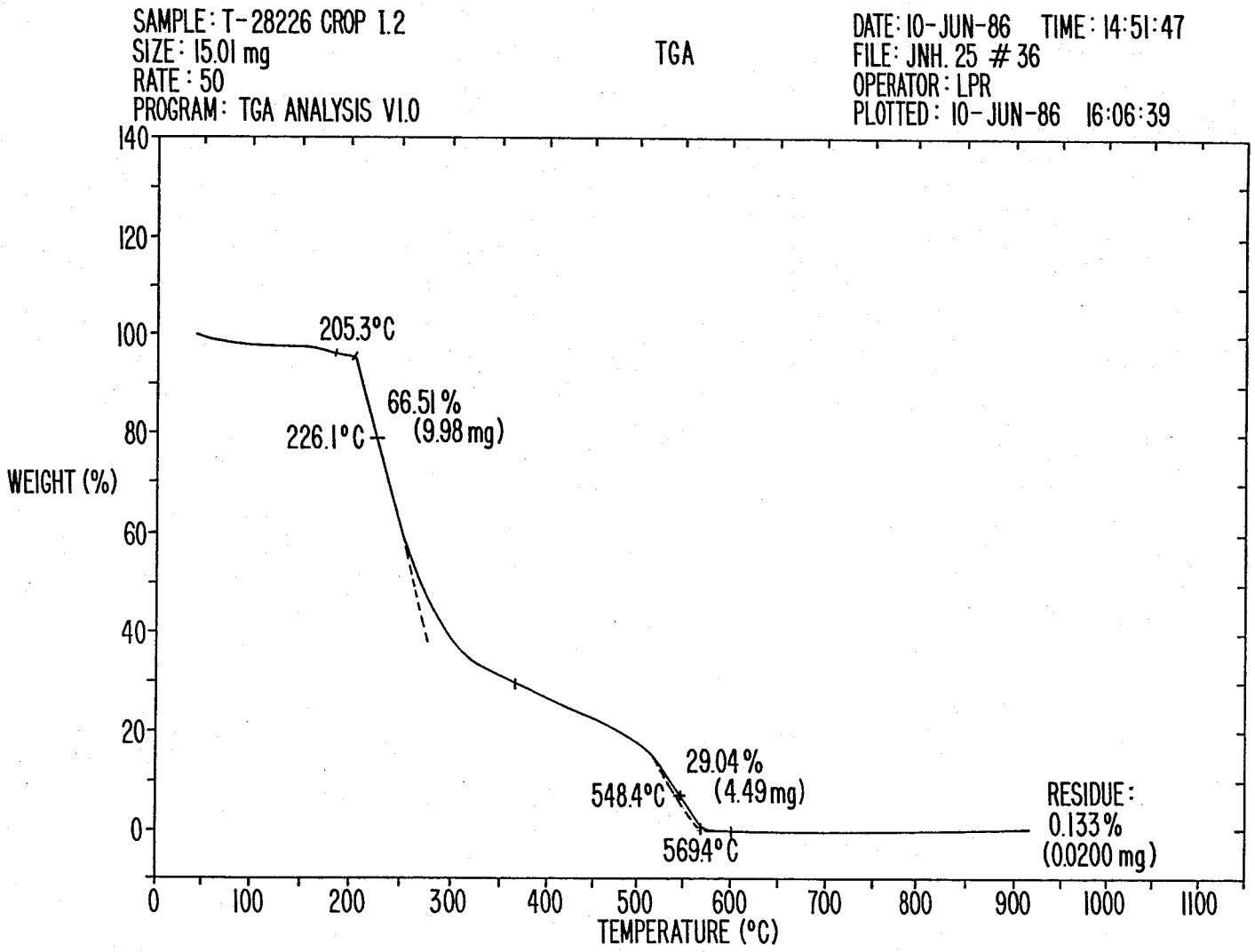
FIG. 3 is a plot of a thermoanalysis of the products produced by a pyrolysis of a product according to the present invention.

A sample of the ethyl vanillyl glucoside prepared by the above procedure was examined by thermogravimetry. Samples were pyrolyzed/combusted in ambient atmosphere using a DuPont 1090 Thermalanalyzer in the thermogravimetric mode. Mass loss corresponding to 66.5% (see FIG. 3) of the beginning material is consistent with the proposed levoglucosan formation/ethyl vanillin loss mechanism. It was noted at the time of the experiment that a vanilla-type aroma was emanating from the exhaust of the TGA.

Pyrolysis of the same material using a Chemical Data Systems Pyroprobe linked to a Hewlett-Packard Model 5890 gas chromotograph gave a product with a retention time identical to that of underivatized ethyl vanillin.

EXAMPLE 3

Cigarettes streaked with ethanolic solutions of ethyl vanillyl glucoside (50 microliters of a 2% w/w solution, 1000 micrograms, 1000 ppm total cigarette basis) were found to release a vanilla aroma on smoldering. It was noted that there was no appreciable transfer of the vanilla taste to the mainstream smoke.

Commercially available cigarettes were purchased and conditioned at standard conditions (72 degrees F., 60% relative humidity) 24 hours before a 2% by weight solution of ethyl vanillyl glucoside, prepared by the above-described procedure was applied to the exterior of the cigarette wrapper by microliter syringe. A range of addition rates were evaluated, 50–1500 ppm total cigarette basis. Levels of 50 ppm were below the threshold detection limits for the five individuals involved in the subjective study of sidestream smoke offensiveness. Increasing the level to 500 ppm placed the level within the perception threshold and most of the test personnel could identify the aroma as vanilla in character. Levels of 1000, 1200, and 1500 ppm incrementally increased the vanilla character of the sidestream smoke without substantially affecting the mainstream smoke taste.

EXAMPLE 4

Ethyl vanillin glucoside tetraacetate was prepared according to the following modified procedure:

In an oven-dried 200 ml round-bottomed flask, ethyl vanillin (50.6 mmol, 8.41 gr), tetraacetyl-α-D-glucosyl chloride (20.0 mmol, 7.34 gr) and anhydrous potassium carbonate (25.2 mmol, 3.45 gr) were combined in methoxyethyl ether (70 ml) under a dry nitrogen atmosphere. The flask was fitted with a water-cooled reflux condenser and heated in an oil bath maintained at 120° C. After 90 minutes, the bath temperature was increased to 130° and maintained there for an additional 90 minutes. A dry nitrogen atmosphere was maintained throughout and the reaction process was monitored by gas chromatography. Upon the disappearance of the peak corresponding to the glucosyl chloride, the reaction mixture was allowed to cool to room temperature under dry nitrogen.

The crude product mixture was then poured into cold brine (500 ml) and extracted with chloroform (4×150 ml). The combined chloroform layers were extracted with cold 3% aqueous sodium hydroxide (2×125 ml), washed with ice water (125 ml) and dried over anhydrous magnesium sulfate. Concentration under reduced pressure provided material sufficiently pure for the deacetylation step (3.21 grams, 32% yield).

EXAMPLE 5

Procedure For The Preparation of Maltol Glucoside Tetraacetate

Maltol (14.9 mmol, 1.88 gr), tetraacetyl-α-D-glucosyl chloride (10.0 mmol, 3.67 gr) and anhydrous potassium carbonate (14.8 mmol, 2.05 gr) were combined in dry (over calcium hydride) tertiary butanol (30 ml) in an oven-dried 100 ml round-bottomed flask fitted with a reflux condenser and gas inlet to maintain a dry nitrogen atmosphere. The reaction mixture was brought to reflux in a 100° C. oil bath and maintained there while monitored by gas chromatography. After 17 hours at reflux, the reaction mixture was allowed to cool to room temperature under dry nitrogen and taken up in dry methanol (150 ml). Filtration through glass wood and concentration under reduced pressure afforded a dark syrup (6.43 gr) which partially solidified on standing. Chromatography on silica gel (225 gr Davisil 62) eluting with a linear gradient of ethyl acetate in carbon tetrachloride gave essentially pure recovered maltol (2.90 gr, mp=159.5°-161° C. from 16% ethyl acetate/-carbon tetrachloride) and the desired maltol glucoside tetraacetate (1.42 gr, 31% yield, mp=143°-145° C.) from 50% ethyl acetate/carbon tetrachloride.

NMR: $CDCl_3$ solvent, TMS internal standard, Bruker A-300 spectrometer, 7.60 ppm (d, J=5.6 Hz, 1H) - H to maltol CO, 6.31 ppm (d, J=5.6 Hz, 1H) −H to maltol CO, 5.34–5.06 ppm (m, 4H) - glucose ring H's, 4.14 ppm (dd, J=25.7 Hz, 12.3 Hz, 1H) and 4.13 ppm (dd, J=25.7 Hz, 12.3 Hz, 1H) - glucose C-6 H's, 3.66–3.60 ppm (m, 1H) - glucose C-5 H; 2.28 ppm (s, 3H), 2.22 ppm (s, 3H), 2.02 ppm (s, 3H), 2.00 ppm (s, 3H) and 1.99 ppm (s, 3H) - acetyl methyls and maltol methyl.

Analysis: $C_{20}H_{24}O_{12}$ requires C=52.63%, H=5.30; Found C=52.30%, H=5.31%.

Deacetylation of Maltol Glucoside Tetraacetate

The maltol glucoside tetraacetate (1.01 mmol, 0.46 gr) produced above was deacetylated by a catalytic amount of sodium methoxide (3 ml 0.22N) in magnesium-dried methanol (9 ml). Reaction was complete after stirring 45 minutes at room temperature. Filtration through Amberlite IR-120(H) exchange resin (1 gr), 20 ml methanol wash, and concentration under reduced pressure yielded an amber syrup (0.27 gr, 93% yield). Purification was effected by column chromatography on silica gel (10.0 gr) eluting with an exponential gradient of methanol/toluene. The desired material was found to elute with 10–20% methanol/toluene. Recrystallization from 95% ethanol gave colorless crystals (mp 114.5°-117° C.).

NMR: $D_2O$ solvent, TSP internal standard, 8.05 ppm (d, J=5.6 Hz, 1H) - Hα to maltol CO, 6.56 ppm (d, J=5.6 Hz, 1H) - Hβ to maltol CO, 4.91 ppm (dm, J=7.5 Hz) - glucose C-1 H, 3.85 ppm (dm, 1H), 3.75 ppm (dm, 1H), 3.60–3.40 ppm (m, 4H), 2.48 ppm (s, 3H) - maltol methyl.

EXAMPLE 6

Cigarettes streaked with an ethanolic solution (100 microliters×40 mg/ml) of the above glucoside generated an aroma resembling cotton candy. Upon dilution of the sidestream smoke in the room air, the aroma becomes less recognizable than that from ethyl vanillin glucoside impregnated cigarettes.

EXAMPLE 7

Pyroprobe Pyrolysis Experiment: Ten microliters of 0.1% solution of maltol glucoside in methanol was applied to quartz wool in the quartz tube pyrolysis probe. This material was pyrolyzed at a ramp rate of 1000° C./min. - comparable to a cigarette's free burn ramp rate - to a final temperature of 650° C. - comparable to the maximum temperature in the cigarette surface - and held at that temperature for five seconds; the entire pyrolysis was performed in a helium atmosphere. Treatment of the glucoside in this fashion generated a peak similar in retention time (4.83 minutes) to the peak generated by the identical treatment of authentic maltol (4.93 minutes). The column used was a DB-5 bonded phase capillary column (0.32 mm×60M column, 1.0 micron film thickness) with helium carrier gas flowing at 1.8 ml/min. The temperature program was 100° C. isothermal for five minutes followed by a 12.5° C./min. ramp to 300° C. isothermal for seven minutes. This insured that any high-boilers did not interfere with subsequent runs. Treatment of ethyl vanillin glucoside and ethyl vanillin under these conditions, with the exception that the temperature ramp rate for the chromatography was 20° C./min, gave peaks with retention times of 15.43 minutes and 15.29 minutes, respectively.

EXAMPLE 8

Procedure For The Preparation of l-Menthol Glucoside Tetraacetate

β-glucose pentaacetate (10.0 mmol, 3.90 gr), in acetic acid/acetic anhydride (5 ml 0.314 gr/ml 95:5 acetic acid: acetic anhydride) were combined in an oven-dried 100 ml round-bottomed flask at room temperature. The flask was fitted with an air condenser, magnetic stirrer and gas inlet to provide a dry nitrogen atmosphere under a slightly positive pressure. The reaction mixture was heated at 100° C. (controlled oil bath) for four hours while being monitored by gas chromatography. The reaction mixture was allowed to cool to room temperature when essentially all of the glucose pentaacetate had been consumed. This material was taken up in methylene chloride (200 ml) and washed with ice water (3×100 ml), saturated sodium bicarbonate (100 ml) and brine (100 ml). Concentration in vacuo after drying over anhydrous magnesium sulfate provided a dark brown oil (5.27 gr, 108% yield) with the characteristic smell of l-menthol. Chromatography on silica gel (105 gr Davisil 62) with a linear gradient of chloroform in carbon tetrachloride provided an amber syrup (2.31 gr, 47% yield) suitable for deacetylation.

Deacetylation of l-Menthol Glucoside Tetraacetate l-Menthol glucoside tetraacetate (2.21 mmol, 1.02 gr) prepared above was dissolved in magnesium-dried methanol (10 ml) in an oven-dried 100 ml round-bottomed flask equipped with a calcium chloride drying tube. Freshly prepared methanolic sodium methoxide (0.2 m 0.1N) was added via syringe and the resulting mixture heated on the steam bath with occasional hand agitation. The solution clouded after 15 minutes upon which the solution was cooled till slightly warm and filtered through a small column (5×30 mm) of Amberlite IR-120(H) exchange resin. Concentration of the filtrate followed by rapid cooling in an ice bath provided colorless crystals. Absolute ethanol (2 ml) was added to aid in the crystallization. Vacuum filtration, air drying and vacuum drying with heat (80° C. 0.07 mm Hg) gave material melting at 152.5°-155° C. NMR: $CDCl_3$ solvent, TMS internal standard, 4.93 ppm (d, J=3.8 Hz, 1H) - glucose C-1, 3.35 ppm (ddd, J=10.6, 10.3, 4.1 Hz; 1H) - CH-OH of menthol, 0.89 ppm (d, J=6.2 Hz, 3H) and 0.87 ppm (d, J=6.1 Hz, 3H) - menthol isopropyl methyls, 0.75 ppm (d, J=6.9 Hz, 3H) - menthol methyl.

EXAMPLE 9

Sample cigarettes were prepared by streaking commercially available cigarettes with an alcoholic solution of the above material (50 microliters 115 mg/ml). Subjective evaluation of the sidestream smoke revealed that there was no aroma conclusively identifiable as that of the smoke flavor notes similar to (-menthol. The effect appeared to be more noticeable in the sidestream than in the mainstream.

EXAMPLE 10

Pyroprobe Pyrolysis Experiment: Conditions identical to the pyrolysis of maltol glucoside were employed. The retention time found for authentic (-menthol was 15.80 minutes; that for the major pyrolysis product (approximately 60%) of the -menthol glucoside was 12.10 minutes. This material has been tentatively identified as menthene from its retention time relative to l-menthol and the structure of the glucoside.

EXAMPLE 11

Procedure for the Preparation of Thymol Glucoside Tetraacetate

In an oven-dried 100 ml round-bottomed flask equipped with a magnetic stirrer, air-cooled reflux condenser and gas inlet to provide a dry nitrogen atmosphere, were combined β-glucose pentaacetate (10.0 mmol, 3.90 gr), thymol (30.0 mmol, 4.51 gr) and a solution of zinc chloride in acetic acid/acetic anhydride (5 ml 0.314 gr/ml 94:5 acetic anhydride). The mixture was held at 100° C. for 2½ hours after which reaction was quenched by pouring the mixture into ice water (300 ml) which was then extracted with methylene chloride (3×100 ml). The combined extracts were washed with water (100 ml), cold 3% sodium hydroxide (2×100 ml), water (100 ml) and then dried over anhydrous magnesium sulfate and concentrated under reduced pressure to yield 6.07 gr (126% yield) brown syrup. Column chromatography on silica gel (135 gr avisil 62), eluting with a linear gradient of methylene chloride in carbon tetrachloride followed by chloroform, gave an amber syrup (2.40 gr, 50% yield) which was composed of two materials, probably C-1 epimers [GC, DB-1 bonded phase capillary column 0.32 mm×30M, 0.25 micron film thickness, temperature program—100° C. (five minutes) ramped to 300° C. (seven minutes) at 12.5° C. per minute. Helium carrier gas at 1.8 m per minute flow rate, retention times of 20.54 and 21.11 minutes.]

I claim:

1. A tobacco product wrapper containing a flavorant glycoside comprising an acetal of a carbohydrate and an aromatic agent or derivative thereof, said flavorant having substantially no aroma below the temperatures at which it pyrolyzes to produce said aromatic agent or derivative thereof, said flavorant being of a character and present in said wrapper in an amount such that during smoldering of said tobacco product which produces a sidestream smoke, said smoldering pyrolyzes said flavorant to release said aromatic agent or derivative thereof which masks the offensive odor of said sidestream smoke and does not significantly transfer to the mainstream smoke produced during smoking of said tobacco product, thereby producing a mainstream of smoke which is not substantially flavored or masked by said aromatic agent or derivative thereof.

2. The wrapper of claim 1 wherein said wrapper is a cigarette paper impregnated with said flavorant.

3. The wrapper of claim 1 wherein said flavorant is a glycoside comprising an acetal of a carbohydrate and said aromatic agent or a derivative thereof.

4. The wrapper of claim 1 wherein said carbohydrate is a saccharide.

5. The wrapper of claim 1 wherein said glycoside is a glucoside.

6. The wrapper of claim 1 wherein said glycoside comprises an acetal of a carbohydrate and vanillin.

7. The wrapper of claim 1 wherein said glycoside comprises an acetal of a carbohydrate and maltol.

8. The wrapper of claim 1 wherein said glycoside comprises an acetal of a carbohydrate and ethyl maltol.

9. The wrapper of claim 1 wherein said glycoside comprises an acetal of a carbohydrate and methyl cyclopentenolone.

10. The wrapper of claim 1 wherein said glycoside comprises an acetal of a carbohydrate and an alpha ketofuranone.

11. The wrapper of claim 1 wherein said glycoside comprises an acetal of a carbohydrate and menthol.

12. The wrapper of claim 1 wherein said glycoside comprises an acetal of a carbohydrate and methyl salicylate.

13. The wrapper of claim 1 wherein said glycoside comprises an acetal of a carbohydrate and eugenol.

14. The wrapper of claim 1 wherein said glycoside comprises an acetal of a carbohydrate and isoeugenol.

15. The wrapper of claim 1 wherein said glycoside comprises an acetal of a carbohydrate and coumarin.

16. The wrapper of claim 1 wherein said glycoside comprises an acetal of a carbohydrate and thymol.

17. An article comprising a tobacco product enclosed in a wrapper and adapted for smoking wherein said wrapper contains a flavorant glycoside comprising an acetal of a carbohydrate and an aromatic agent or derivative thereof, said flavorant having substantially no aroma below the temperature at which it pyrolyzes to produce said aromatic agent or derivative thereof, said flavorant being of a character and present in said wrapper in an amount such that during smoldering of said tobacco product which produces a sidestream smoke, said smoldering pyrolyzes said flavorant to release said aromatic agent or derivative thereof which masks the offensive odor of said sidestream smoke and does not significantly transfer to the mainstream smoke produced during smoking of said tobacco product, thereby producing a mainstream of smoke which is not substantially flavored or masked by said aromatic agent or derivative thereof.

18. The article of claim 2 wherein said wrapper is a cigarette paper impregnated with said flavorant.

19. The article of 17 wherein said carbohydrate is a saccharide.

20. The article of claim 17 wherein said glycoside is a glucoside.

21. The article of claim 17 wherein said glycoside comprises an acetal of a carbohydrate and vanillin.

22. The article of claim wherein said glycoside comprises an acetal of a carbohydrate and ethyl vanillin.

23. The article of claim 17 wherein said glycoside comprises an acetal of a carbohydrate and maltol.

24. The article of claim 17 wherein said glycoside rises an acetal of a carbohydrate and ethyl maltol.

25. The article of claim 17 wherein said glycoside comprises an acetal of a carbohydrate and methyl cyclopentenolone.

26. The article of claim 17 wherein said glycoside comprises an acetal of a carbohydrate and an alpha ketofuranone.

27. The article of claim 17 wherein said glycoside comprises an acetal of a carbohydrate and menthol.

28. The article of claim 17 wherein said glycoside comprises an acetal of a carbohydrate and methyl salicylate.

29. The article of claim 17 wherein said glycoside comprises an acetal of a carbohydrate and eugenol.

30. The article of claim 17 wherein said glycoside comprises an acetal of a carbohydrate and isoeugenol.

31. The article of claim 17 wherein said glycoside comprises an acetal of a carbohydrate and coumarin.

32. The article of claim 17 wherein said glycoside comprises an acetal of a carbohydrate and thymol.

33. The wrapper of claim 1 wherein said flavorant is a glycoside propenyl quaethol.

34. The article of claim 17 wherein said glycoside comprises propenyl quaethol.

* * * * *